United States Patent [19]

Wimmer

[11] 4,005,920

[45] Feb. 1, 1977

[54] VACUUM-TIGHT METAL-TO-METAL SEAL

[75] Inventor: Jack D. Wimmer, Roanoke, Va.

[73] Assignee: International Telephone and Telegraph Corporation, Nutley, N.J.

[22] Filed: July 9, 1975

[21] Appl. No.: 594,376

[52] U.S. Cl. ..... 316/19; 316/17

[51] Int. Cl.[2] ..... H01J 9/18

[58] Field of Search ..... 316/17, 19

[56] References Cited

UNITED STATES PATENTS

| | | | |
|---|---|---|---|
| 2,910,338 | 10/1959 | Yoder | 316/19 |
| 2,984,759 | 5/1961 | Vinc | 316/17 |
| 3,353,890 | 11/1967 | Legoux | 316/19 |
| 3,853,374 | 12/1974 | Flasche | 316/19 |

*Primary Examiner*—W. Tupman

*Attorney, Agent, or Firm*—John T. O'Halloran; Peter Van Der Sluys; Richard A. Menelly

[57] ABSTRACT

Methods and apparatus are provided for efficiently processing vacuum tubes containing microchannel plate electron multipliers. The vacuum tube body containing the microchannel plate is thermally treated under vacuum prior to sealing the tube faceplates by means of reversible melted metal seals.

12 Claims, 8 Drawing Figures

VACUUM-TIGHT METAL-TO-METAL SEAL

BACKGROUND OF THE INVENTION

The introduction of microchannel plate electron multiplier devices to the image tube industry creates serious manufacturing problems. The image tubes require ultra-high vacuum conditions to function properly and the microchannel plate multiplier generates a substantial quantity of gas during tube processing. The microchannel plate electron multiplier selected by the tube industry for efficient electron multiplication properties and compactness in size, consists generally of a porous glass disc. The glass body is treated to render secondary emission properties to the interior of the multitude of glass pores extending through the disc. The larger specific surface area provided by the microscopic pores serve as a haven for absorbed gas molecules which must be removed before an operable image tube device can be produced.

Current methods for processing image tube devices containing the microchannel plate electron multiplier usually consist in inserting the microchannel plate within an open-ended tube body and heli-arc welding one faceplate to one end of the tube. The tube is then transferred to a process station where a photocathode is deposited on another faceplate which is subsequently sealed to the open end of the tube while maintaining the tube assembly in ultra-high vacuum. The problem encountered in tubes processed containing the microchannel plate is reflected in the substantial amount of time required in the evacuation process to assure that the microchannel plate is out-gassed as completely as possible. Substantially long processing times are required since the microchannel plate must remain under evacuation when standard ion pumps are employed to assure that the microchannel plate is thoroughly out-gassed. Attempts to decrease the long processing schedules by means of electron bombardment of the microchannel plate have reduced the processing time requirements to a certain extent, however, substantial processing times are still required.

One purpose of this invention therefore is to provide apparatus and methods for substantially decreasing the amount of processing time required for out-gassing image tube devices containing microchannel plate electron multipliers.

SUMMARY OF THE INVENTION

Vacuum tube devices containing microchannel plate electron multipliers are processed by enclosing an open-ended vacuum tube body member in a vacuum chamber and heating and evacuating the microchannel plate through both ends of the vacuum tube body. The vacuum tube faceplates are then attached to the tube ends by means of a low melting point alloy while maintaining the tube components under conditions of high vacuum.

DESCRIPTION OF THE PREFERRED EMBODIMENTS

Figure 1:
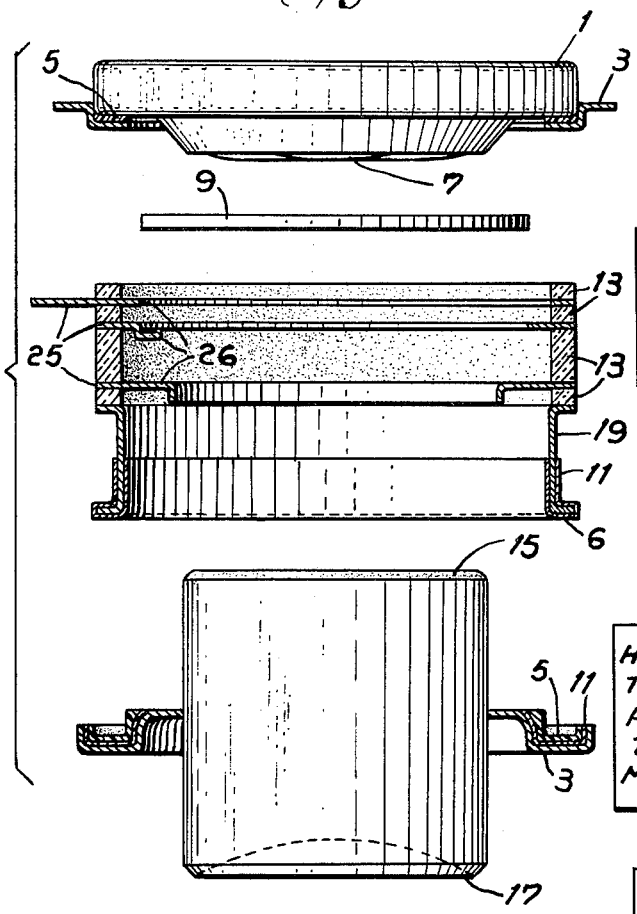
FIG. 1 is an exploded front perspective view of the tube components of this invention.

FIG. 1 shows the components of a typical image intensifier tube prior to assembling and processing into a finished tube assembly. A cathode fiber optic faceplate 1 is sealed into a concentric metal ring 3 which has previously been coated with a plurality of metal layers such as a first layer of inconel metal followed by a layer of copper and a final layer of an alloy of indium and bismuth 5. The indium-bismuth coating 5 generally consists of an alloy having the concentration of 66 ⅔% indium and 33 ⅓% bismuth in order to have an approximate melting point of 60°–70° C. The substrate metals, such as inconel and copper, are generally coated onto the cathode fiber optic faceplate 1 by vacuum evaporation process. However, other methods are suitable providing particular care is taken to avoid contacting the metals with the flat region of the fiber optic faceplate 1. In the tube fabrication process, a microchannel plate 9 is provided and consists of a porous glass disc having secondary electron emission properties. The microchannel plate 9 is prepared by leaching a plurality of microscopic holes from a specially drawn fiber bundle consisting of fibers having a core member soluble in the leaching substance and a cladding member which remains in tact during the leaching process. The secondary electron emission properties are imparted by means of partially reducing the porous glass structure by hydrogen treatment or by a suitable process capable of chemically reducing the glass composition to render the glass emissive upon electron impact. The tube body 19 comprises an alternate series of metal contact rings 25 and ceramic rings 13 fused into a continuous open-ended and concentric cylinder. The metal contact rings 25 provide electrical access to the various components to be assembled within the tube body 19. The ceramic rings 13 are necessary to provide good electrical insulation between the alternate metal contact rings 25. The fiber optic faceplate 17 consists of an optical fiber bundle that is generally twisted 180° around its circumference so that the image of an object entering through one face of the fiber faceplate 17 will become inverted upon exiting through the opposite face by means of the twisted structure imparted to the phosphor fiber optic faceplate 17.

Prior to assembling the fiber optic faceplate 17 with the tube body 19, a layer of phosphor 15 is supplied to one face of the fiber optic faceplate 17. The phosphor type chosen depends upon the particular image tube application and, for the purpose of this embodiment, comprises a type P-20 phosphor which has good spectral response characteristics within the visible portion of the spectrum. The phosphor is excited by electron impact generated at the surface of the cathode fiber optic faceplate 1 and amplified through the microchannel plate 9. The phosphor 15 is applied from a water base suspension containing a quantity of sodium bicarbonate and potassium silicate followed by the evaporation of an aluminum screen similar to standard cathode ray tube and television phosphor screens. Prior to the application of the phosphor coating 15 a concentric metal ring 3 is generally sealed to the fiber optic faceplate 17 and the metal ring 3 is first coated with a succession of inconel and copper layers or gold plated before the application of an indium-bismuth coating 5 as described for the cathode fiber optic faceplate metal ring 3.

Figure 3:
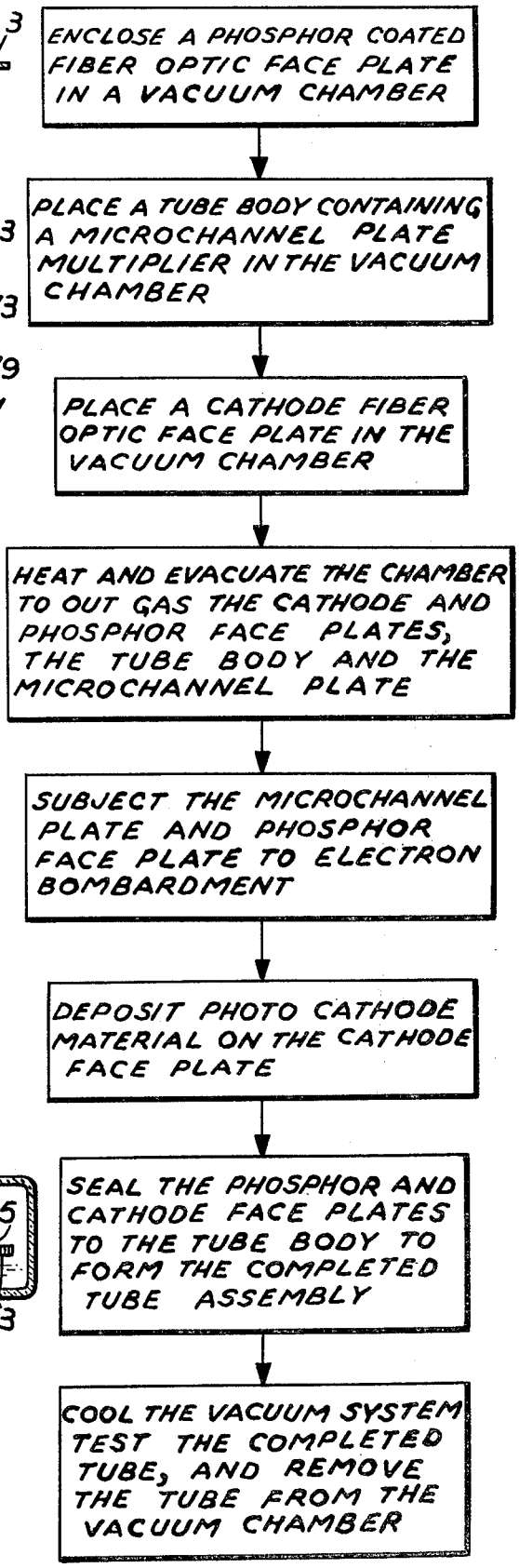
FIG. 3 is a diagrammatic representation of the steps for processing the tube components of FIG. 1.

The steps for assembling and processing the tube components are shown in FIG. 3 where one particular method for assembling and processing the tube is illustrated. The steps illustrated in FIG. 3 are not in a necessary order of arrangement but are listed as one method of illustrating the inventive process. The phosphor coating 15, for example, may possibly be applied within the vacuum chamber by a process other than sedimentation form a liquid suspension and photocathode material 7 could possibly be applied in air prior to enclosing the cathode fiber optic faceplate 1 in a vacuum chamber.

Figure 2:
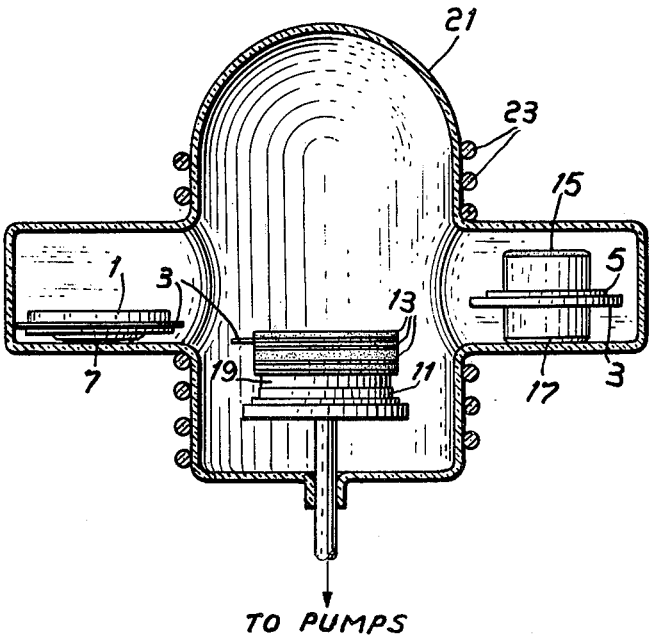
FIG. 2 is an exploded front perspective view of the components of FIG. 1 in a vacuum chamber.

FIG. 2 shows the tube components prior to assembly in a vacuum chamber 21. The vacuum chamber 21 includes the necessary equipment for moving the components within the vacuum system without in any way exposing the components to air or any other source of contamination. The ability to transfer the components within vacuum chamber 21 is provided by magnetically actuated extending arms (not shown) which allow an operator to pick up and transfer any of the tube components independently from the other tube components. When the vacuum tube components are enclosed within the vacuum chamber 21 of FIG. 2, the vacuum chamber is evacuated by means of a series of vacuum pumps in order to assure that the residual pressure within the chamber 21 is at a low enough value so as not to contaminate or oxidize the tube components when subsequent heat is applied.

After a particular vacuum level was obtained for the embodiment of FIG. 2, and after subjecting the cathode fiber optic faceplate 1 to electron bombardment to insure sufficient removal of surface gases, a plurality of layers of alkali metal photocathode material 7 were applied to the cathode fiber optic faceplate 1 in a region of the vacuum chamber 21 which allowed successive evaporation of the material 7 without contacting the tube body 19. Outgassing of all the tube components within the chamber 21 was provided by energizing heating elements 23 and gradually increasing the temperature of the chamber 21 and programming the rate of temperature increase so that the effluent gas molecules could be effectively removed from the chamber 21 by means of vacuum pumps without contaminating the tube components. The tube body 19, open at both top and bottom, readily provides pumping access to the enclosed microchannel plate 9. Prior methods for evacuating the vacuum tube assembly attempted to out-gas the microchannel plate 9 with the fiber optic faceplate 17 already welded to the tube body 19. With both the cathode fiber optic faceplate 1 and the phosphor fiber optic faceplate 17 unattached to the tube body 19 during the evacuation process, as disclosed herein, the actual processing time can be substantially reduced since the absorbed gases within the microchannel plate 9 can readily exit from both ends of the tube body 19. In order to further facilitate the out-gassing of the microchannel plate 9 auxiliary apparatus (not shown) provides a source of electrons where the microchannel plate 9 serves as a target. Here extensive bombardment by electrons can occur since the pumping rate proceeds at a rate sufficient to sweep the effluent gas molecules from the vicinity of the microchannel plate 9 without causing the gas molecules to ionize and destroy the tube by excessive electron avalanche.

After heating the vacuum chamber 21 until the ultimate desired vacuum has been achieved, the cathode fiber optic faceplate 1 and the fiber optic faceplate 17 are then attached to the ends of tube body 19 without removing the tube components from the vacuum chamber 21. Various materials that are meltable and are capable of creating a good vacuum seal may be employed to attach the faceplates to the tube body 19 such as low temperature melting glasses, ceramics and metals. Tin, indium, gallium, in various combinations or as a liquid amalgam with mercury may also be employed. For the purpose of this embodiment the particular indium-bismuth alloy 5 described earlier is chosen due to the good vacuum sealing properties and the low melting temperatures required. The order of sealing either faceplate is not critical to this invention, however, for this embodiment the phosphor fiber optic faceplate 17 is sealed first by the following method. A metal rod (not shown) is used to skim the melted indium-bismuth surface in order to remove any traces of impurities and to present an oxide free surface for mating with the gold coating 11 of the tube body 19. When the indium-bismuth surface presents a clear, highly reflective surface layer, the phosphor fiber optic faceplate 17 is then transferred over to tube body 19 and the indium-bismuth coating 5 is brought into contact with and wets gold coating 11. In order to assure a good vacuum-tight seal either the tube body 19 or the fiber optic faceplate 17 is rotated while the indium-bismuth alloy continuously wets and adheres to the gold film 11 on the bottom surface of tube body 19. The melting of the indium-bismuth coating 5 under high vacuum conditions minimizes the possibility that trapped or absorbed gas molecules will be retained by the indium-bismuth when cooled to its solid state, and therefore eliminates the indium-bismuth material as a possible source of gas contamination within the finished tube. After the fiber optic faceplate 17 is made to contact the tube body 19 the temperature of the fiber optic faceplate 17 can be dropped to below the 60° – 70° C required to retain the indium-bismuth in a melted state to solidify the indium-bismuth material, or the fiber optic faceplate 17 can be kept at a temperature in excess of the indium-bismuth melting point until the tube is completely processed.

The cathode fiber optic faceplate 1 is now transferred under vacuum so that the indium-bismuth coating 5 on metal ring 3 contacts the gold coating 11 on the opposite rim of the tube body 19. As stated earlier, the surface of the indium-bismuth coating 5 can be continuously skimmed by means of a metal rod to assure that a continuously clean surface is exposed for good wetting properties between the indium-bismuth coating 5 and the gold coating 11. The cathode fiber optic faceplate 1 may be rotated while the indium-bismuth coating 5 is in a melted state to assure good contact and to completely outgas any absorbed gas molecules from the indium-bismuth material. After the cathode fiber optic faceplate 1 has been sealed to the tube body 19, the final assembly steps for the tube have been completed. Further processing steps may be carried out while the tube is kept within the vacuum chamber 21, such as activating an evaporable type getter to provide continuous pumping action to the sealed tube, and performing various electronic testing procedures.

The advantages of the reversible properties of the melted metal seal are readily apparent when, for example, the tube fails to meet a particular test standard after assembly. While the tube is still within the vacuum chamber 21 either the fiber optic faceplate or the cathode fiber optic faceplate 1, or both, can be readily removed by increasing the heat in the vicinity of the faceplates to re-melt the indium-bismuth coating 5 and to provide access to the tube contents. Spare operable parts may be located within the vacuum chamber so that replacement or reprocessing can occur without removing the tube from the chamber should such replacement or reprocessing become necessary. It is to be further noted that several tubes can be processed at one time within the same chamber by batch processing techniques since the chamber can be designed to house as many tube components as desired for batch processing and assembly.

After the tube has been completely processed within the vacuum tube 21 and all the aforementioned electronic tests have been performed, the tube can be removed from the vacuum chamber 21 and subjected to further testing within the atmosphere. Prior to removing the assembled tube from the vacuum chamber 21, a positive pressure test can be applied to the tube to assure that the aforementioned melted metal seals are vacuum tight. This test is performed by back filling the vacuum chamber 21 with an inert gas to a pressure in excess of one atmosphere and electronically monitoring the tube to determine whether electrical conduction occurs through the tube after a predetermined period of time. In this instance the tube behaves as an ion guage and the occurrence of ion current through the tube is an immediate indication of the residual gases remaining in the assembled tube. In the event that the tube should become defective for any reason, or fail to pass further inspection procedures subsequent to exposure to air, the tube can be returned to the vacuum chamber 21 and dismounted by means of the aforementioned re-melting of the indium-bismuth seals.

By means of the demountable properties afforded to the vacuum tube of this invention, the finished tube at any stage of operation can be salvaged and repaired. This is particularly important since the types of image tube devices that are manufactured in this manner are usually very expensive so that reclamation of any of the component parts can result in a substantial cost savings. One example of an end-of-life failure condition for the image tube is deactivation of the photocathode material 7. In this type of normal operational failure the other tube components, such as microchannel plate 9 and the phosphor coating 15, are still capable of functioning within design specification parameters. The tube can then be dismounted (as described earlier) and the photocathode material 7 can be replaced by re-evaporating the afore-mentioned alkali metals.

Figure 4:
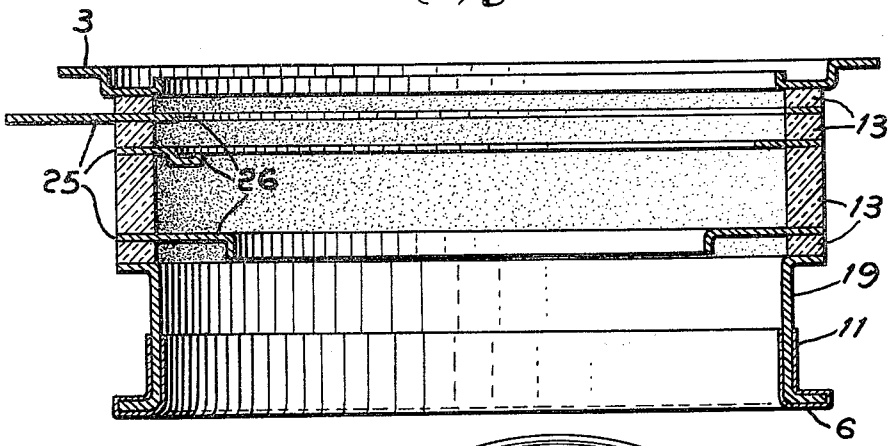
FIG. 4 is an enlarged side sectional view of the tube body of FIG. 1.

FIG. 4 shows the tube body in enlarged detail. Here the metal tube body 19 is shown with the gold coating 11 on the interior and exterior rims of the bottom open end. The series of metal contact rings 25 are shown sealed to the intermittant ceramic rings 13. The metal contact rings 25 not only provide electrical contact to the components within the tube, but also provide support structure for the internal components as can be seen by the inner extending members 26. The required spacing between the components for electrostatic or proximity focusing can be established by the spacing provided by means of these extending members 26.

Figure 6:
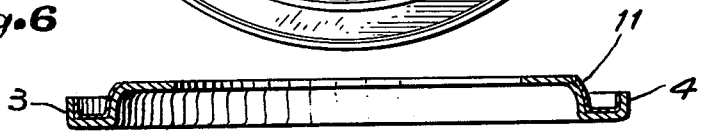
FIG. 6 is a cross-section of the ring of FIG. 5.

FIG. 6 shows one configuration of the metal ring 3 where the metal ring 3 has a first surface 4 and a second surface 6 raised above the first surface 4. FIG. 6 shows the first surface 4 of the ring 3 containing a substrate gold coating 11 under the indium-bismuth 5. The contour of the first surface 4 co-operatively mates with the bottom contour 6 of tube body 19 as shown in FIG. 4.

Figure 7:
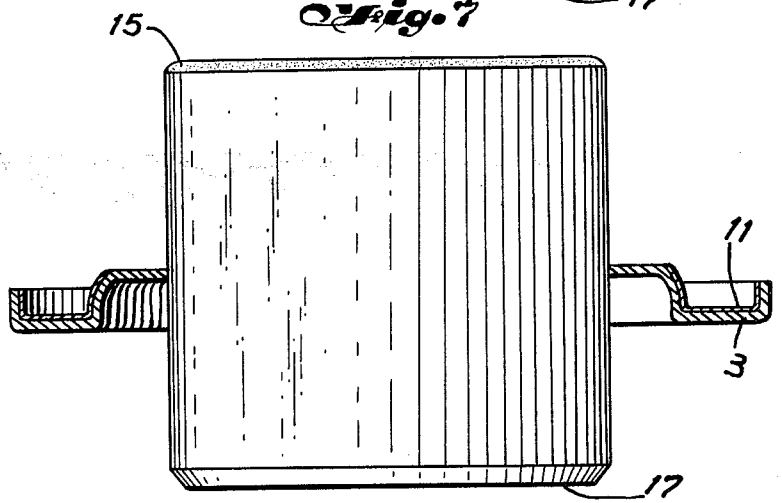
FIG. 7 is an enlarged side sectional view of the phosphor fiber optic faceplate of FIG. 1 sealed within the metal ring of FIGS. 5 and 6.
Figure 5:
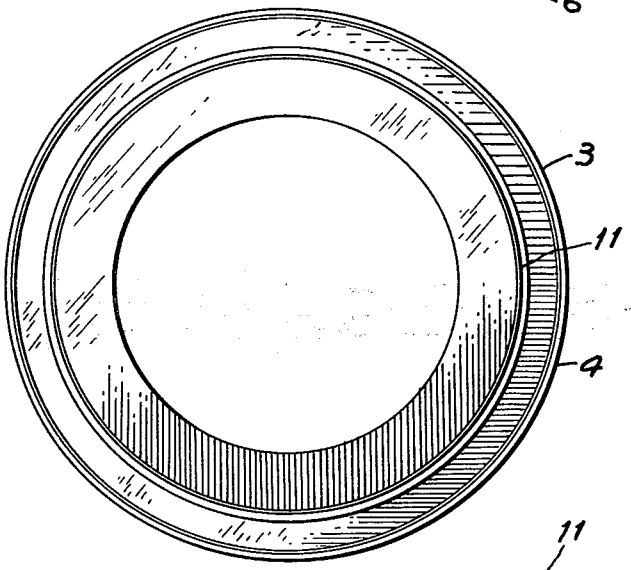
FIG. 5 is an enlarged top view of the metal ring of FIG. 1.

FIG. 7 shows the fiber optic faceplate 17 sealed to the metal ring 3 described earlier in FIGS. 5 and 6. The fiber optic faceplate 17 is sealed to the concentric metal ring 3 by raising the temperature of the fiber optic faceplate 17 to melt an intermediate low melting glass frit although other methods such as meltable-metal sealing could be provided.

Figure 8:
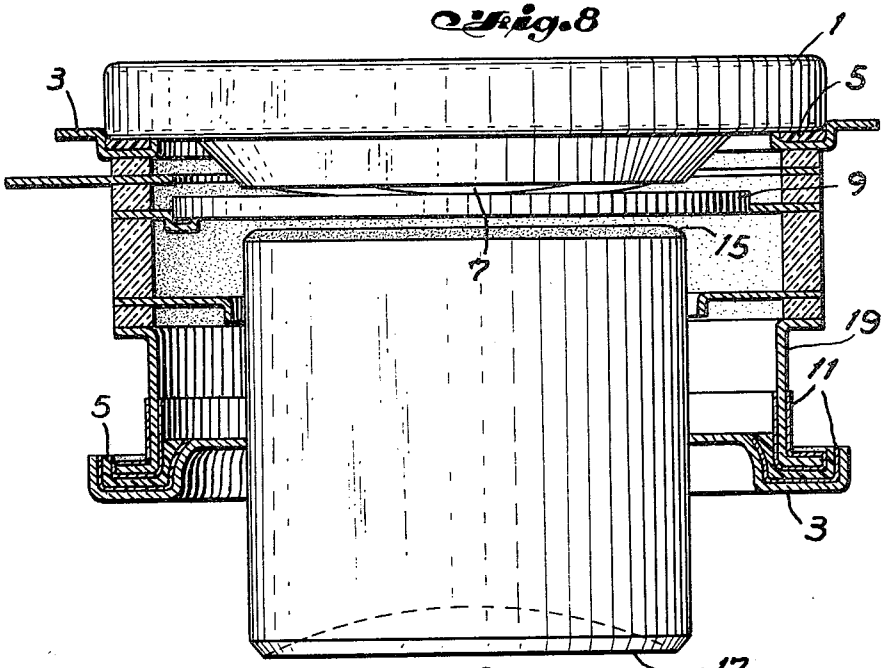
FIG. 8 is an enlarged side sectional view of the assembled tube components of FIG. 1.

FIG. 8 shows a completely assembled image tube assembled by the method of this invention. Here the phosphor fiber optic faceplate 17, sealed to the metal ring 3, is shown with its phosphor coating 15 in optical proximity to the microchannel plate 9. The indium-bismuth coating 5 over the gold coating 11 of the metal ring is shown fixedly securing the metal tube body 19 to the phosphor fiber optic faceplate 17. The cathode fiber optic faceplate 1 containing the photocathode material 7 is mounted within the tube close to the microchannel plate 9 on the opposite side from the phosphor fiber optic faceplate 17. Here again the indium-bismuth coating 5 is shown fixedly adhering the cathode fiber optic faceplate to the tube. The image intensifier tube of this embodiment becomes operative when light is transmitted through the cathode fiber optic faceplate 1 and contacts the photocathode material 7. Here photoelectrons are directed, by means of voltage gradients applied across appropriate metal contact rings 25, to the microchannel plate 9. The electrons are multiplied within the microchannel plate 9 and are directed to strike the phosphor coating 15 by electron accelerating voltages applied between appropriate metal contact rings 25. The phosphor coating 15 emits visible light which traverses through the fiber optic faceplate 17 where it becomes geometrically inverted as described earlier.

Methods and apparatus have herein been disclosed which relate to vacuum tube devices requiring high vacuum metal-to-metal seals. This is by way of example only and is in no way intended to limit the scope of this invention. The invention finds application in television picture tubes, and gas discharge devices where removable melt-type seals also prove advantageous.

What is claimed is:

1. A method of processing a vacuum tube assembly comprising the steps of:

enclosing an open-ended vacuum tube body member containing a microchannel plate electron multiplier in a vacuum chamber;

positioning a phosphor coated first faceplate in said vacuum chamber proximate one end of said tube body;

placing a second faceplate in said vacuum chamber proximate another end of said tube body;

evacuating said vacuum chamber and heating said body member, said microchannel plate, and said faceplate to remove adsorbed gases from said body, microchannel plate and said faceplates;

moving said first faceplate into contact with said one end of said tube body;

sealing said first faceplate to said one end of said tube body;

moving said second faceplate into contact with said other end of said tube body;

sealing said second faceplate to said other end of said tube body to provide a vacuum-tight assembly; and removing said vacuum tube assembly from said vacuum chamber.

2. The method of claim 1 wherein said first and second faceplates comprise glass faceplates.

3. The method of claim 2 wherein said glass faceplates comprise fiber optic faceplates.

4. The method of claim 1 including the step of depositing a photocathode layer on said second faceplate while evacuating said vacuum chamber.

5. The method of claim 1 wherein sealing said first faceplate further comprises the steps of: heating said tube body and said first faceplate to melt an intermediate metal coating; and cooling said first end of said tube body and said first faceplate to solidify said intermediate metal coating.

6. The method of claim 1 wherein sealing said second faceplate further comprises the steps of:

heating said second faceplate and said tube body to melt an intermediate metal coating; and cooling said second faceplate and said other end of said tube body to solidify said intermediate metal coating.

7. The method of claim 6 wherein said intermediate metal coating is selected from the group of metals consisting of indium, bismuth, mercury and tin.

8. The method of claim 7 wherein said metal coating comprises an alloy of indium and bismuth, said indium content being higher than said bismuth.

9. The method of claim 5 wherein said first faceplate contains a substrate layer of a material having a higher melting point than said metal coating.

10. The method of claim 5 wherein said open-ended vacuum tube body member contains a substrate layer of a material having a higher melting point than said metal coating.

11. The method of claim 10 wherein said material is selected from the group of metals consisting of copper, nickel and gold.

12. A method of processing an image intensifier tube assembly comprising the steps of:

sealing a phosphor-coated first fiber optic faceplate within a first metal ring;

depositing a gold layer on said first metal ring;

placing a coating of an alloy of bismuth and indium on said gold layer;

inserting a microchannel plate electron multiplier within an open-ended metal tube body having a thin layer of gold at both ends thereon;

sealing a second fiber optic faceplate within a second metal ring;

depositing a gold layer on said second metal ring;

placing a coating of an alloy of bismuth and indium on said gold layer;

enclosing said first and second faceplates and said tube body within a vacuum chamber;

heating and evacuating said vacuum chamber to out-gas said faceplates, said tube body, and said microchannel plate;

subjecting said microchannel plate to electron bombardment to further out-gas said microchannel plate;

transferring said first faceplate into contact with one end of said tube body while evacuating said chamber;

heating said tube body and said first faceplate to melt said coating of indium and bismuth and adhere said first faceplate to said one end of said tube body, said one end of said tube body and said first faceplate being in contact therewith said melted indium and bismuth coating;

applying a photocathode to said second faceplate;

transferring said second faceplate into contact with another end of said tube body while evacuating said chamber;

heating said tube body and said second faceplate to melt said coating of indium and bismuth to adhere said second faceplate to said other end of said tube body to form a vacuum-tight tube assembly, both said other end of said tube body and said second faceplate being in contact therewith said melted coating of indium and bismuth;

cooling said tube assembly to solidify said melted coatings of indium and bismuth; and removing said tube assembly from said vacuum chamber.

* * * * *